United States Patent [19]

Preston et al.

[11] 4,023,577

[45] May 17, 1977

[54] MANUFACTURE OF CIGARETTES

[75] Inventors: Edward George Preston; Jan Antoni Rakowicz, both of London, England

[73] Assignee: Molins Limited, Great Britain

[22] Filed: Feb. 3, 1975

[21] Appl. No.: 546,674

[30] Foreign Application Priority Data

Feb. 5, 1974 United Kingdom ..... 5366/74

[52] U.S. Cl. ..... 131/94

[51] Int. Cl.² ..... A24C 5/52

[58] Field of Search ..... 131/94, 72; 93/1 C, 93/77 FT; 198/20 C, 28

[56] References Cited

UNITED STATES PATENTS

| | | | |
|---|---|---|---|
| 2,808,059 | 10/1957 | Stelzer | 131/94 |
| 3,058,475 | 10/1962 | Gamberini | 131/94 |
| 3,059,651 | 10/1962 | Molins et al. | 131/94 |
| 3,367,341 | 2/1968 | Skala | 131/72 X |
| 3,526,233 | 9/1970 | McArthur | 131/94 |

FOREIGN PATENTS OR APPLICATIONS

| | | | |
|---|---|---|---|
| 1,190,856 | 4/1965 | Germany | 131/94 |

*Primary Examiner*—Robert W. Michell
*Assistant Examiner*—V. Millin
*Attorney, Agent, or Firm*—Craig & Antonelli

[57] ABSTRACT

In apparatus for causing rod-like articles to roll through a channel defined by opposed surfaces in which rolling is caused by relative movement of the surfaces, the channel is provided with a region of reduced width at the point of entry of the articles into the channel so that there is a positive start to rolling. A particular application is in a filter cigarette assembly machine in which axially aligned filter and tobacco portions are joined by wrapping them in a "cork" section while they are rolled through a channel between a rolling drum and a rolling plate.

20 Claims, 3 Drawing Figures

MANUFACTURE OF CIGARETTES

This invention relates to apparatus for causing rod-like articles such as cigarettes to roll along a predetermined path. In a particular aspect the invention is concerned with machines for joining filters or other mouthpieces to tobacco-filled rods to form what will be termed "filter-tipped cigarettes".

The present invention provides apparatus for causing rod-like articles such as cigarettes to roll along a predetermined path, comprising a channel having a width defined by opposed surfaces through which channel rod-like articles may be moved transversely, at least one of said surfaces being movable relative to the other surface whereby a rod-like article may be caused to roll relative to said surfaces through said channel, and means for delivering rod-like articles into said channel at an end of the channel, wherein said channel includes a first region adjacent said end and a second region on the opposite side of the first region to said end, the width of the channel in the first region being less than that in the second region.

In one known form of filter-attachment machine used by the present applicants, assemblies each comprising a double-length filter and two tobacco portions abutting opposite ends of the filter are secured by a web of wrapping paper (commonly termed "cork") in the following way. The assemblies are fed in the flutes of a fluted drum towards a rolling drum which carries spaced portions of wrapping paper, and are rolled on the rolling drum, thus wrapping the wrapping paper around the assemblies,by means of a rolling plate. The rolling plate has fingers which extend into circumferential grooves in the fluted drum to assist in removing the assemblies from the fluted drum and to begin the rolling. The portions of wrapping paper have adhesive applied to them before the rolling station, and the adhesive may be dried with the aid of heat applied, for example, to the rolling drum itself and to the rolling plate.

The invention may be applied to this form of filter-attachment machine: the rolling plate may then be so shaped that the fingers define the first region of the channel with the rolling drum so that the channel is narrower there than in the second region defined between the rolling drum and the main body of the rolling plate. Thus the assemblies are moved initially through the relatively narrow first region of the channel between the rolling drum and the fingers of the rolling plate, so as to be tightly gripped, and then pass through the slightly wider second region of the channel, between the rolling drum and the main body of the rolling plate, in which the rolling continues. The change from one channel width to the other may be represented by a slight step at the junction between the fingers and the body of the rolling plate.

It is believed that the invention is beneficial in its application to this form of filter-attachment machine for the following reasons. The assemblies tend to bulge out between the fingers, and on reaching the main body of the rolling plate it is believed that the assemblies were possibly arrested temporarily in their forward motion by the bulging portions. The increase in the width of the channel for the assemblies on arriving at the body of the rolling plate allows relief for those bulging portions.

The operative faces of the fingers may be serrated to improve their grip on the assemblies and to reduce the possibility of skidding. At least part of the rolling plate, preferably at least an area in the vicinity of the double-length filters, may also be serrated.

An example of a filter-attachment machine incorporating the invention is shown in the accompanying drawings. In these drawings.

Figure 1:
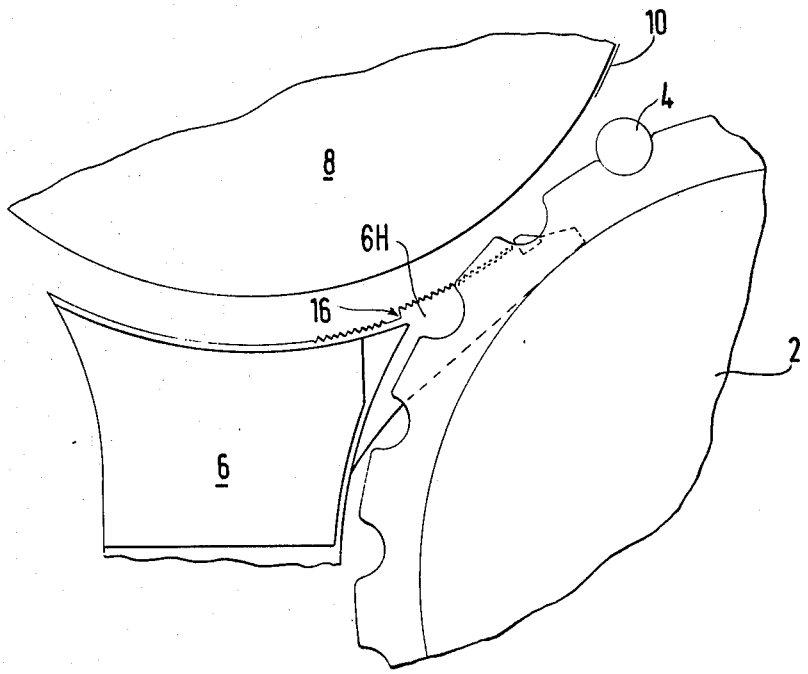
FIG. 1 is a fragmentary side view of part of the machine.

As shown in FIG. 1, a fluted suction drum 2 carries assemblies 4 towards a rolling plate 6. Each assembly 4 arrives at a point of contact with a rolling drum 8 just ahead of a portion of wrapping paper 10 carried by the rolling drum 8 by means of suction, for example, in the well-known manner. On reaching the rolling drum 8, the assembly is stripped from the fluted drum 2 (at which point suction on the fluted drum ceases) by means of fingers 6A to 6H (FIG. 3) on the rolling plate 6. These fingers begin to roll the assembly with respect to the drum 8; soon after rolling commences, the leading edge of the wrapping portion 10, which carries an adhesive, catches up with the assembly, and the wrapping portion 10 is then wrapped around the assembly as a result of the rolling of the assembly relative to the drum 8.

Figure 3:
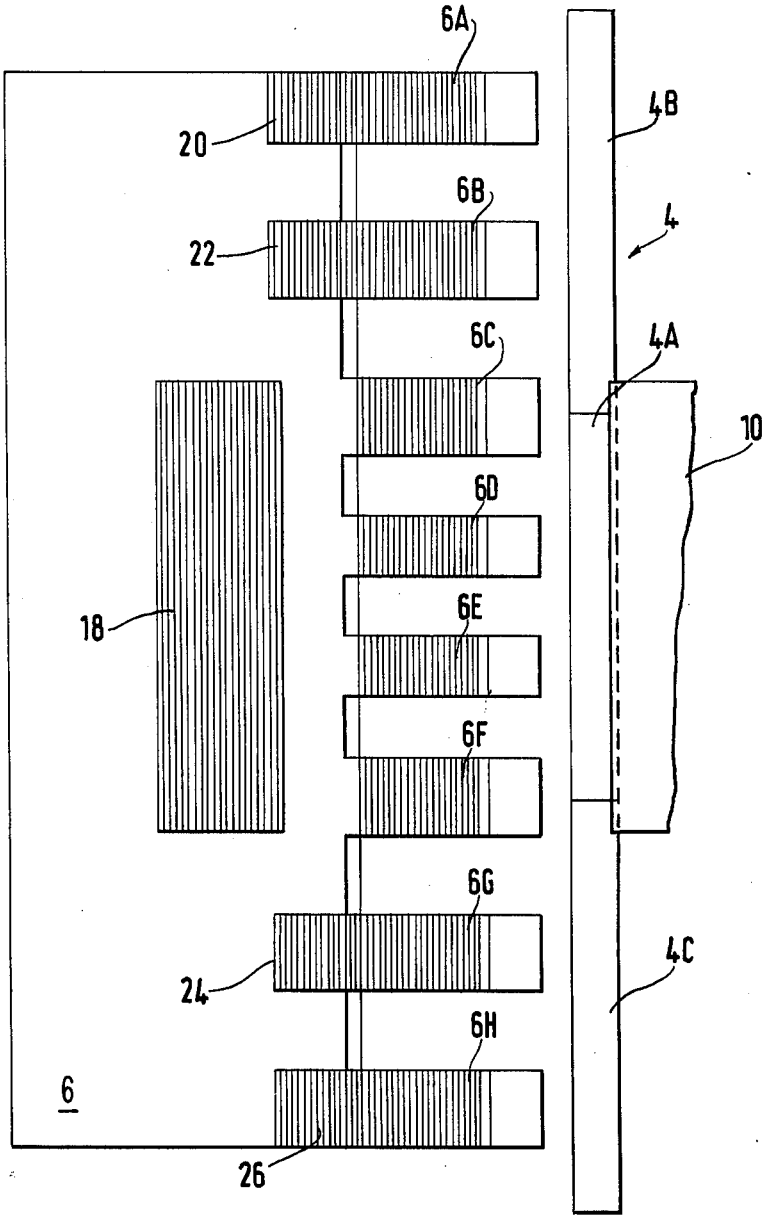
FIG. 3 is a flat developed view of the operative surface of the rolling plate.

FIG. 3 shows a complete assembly, which comprises a double-length filter portion 4A and two tobacco portions 4B and 4C. The leading edge of a portion 10 of wrapping paper is also shown in FIG. 3; it should be noted that the width of the portion 10 is sufficient to span the length of the double-length filter 4A and to overlap the adjacent ends of the tobacco portions 4B and 4C.

It will be understood that the fingers 6A to 6H of the rolling plate enter circumferential grooves in the fluted drum 2. In other words, the assembly 4 is supported on the drum 2 at positions between the fingers and at its ends.

Figure 2:
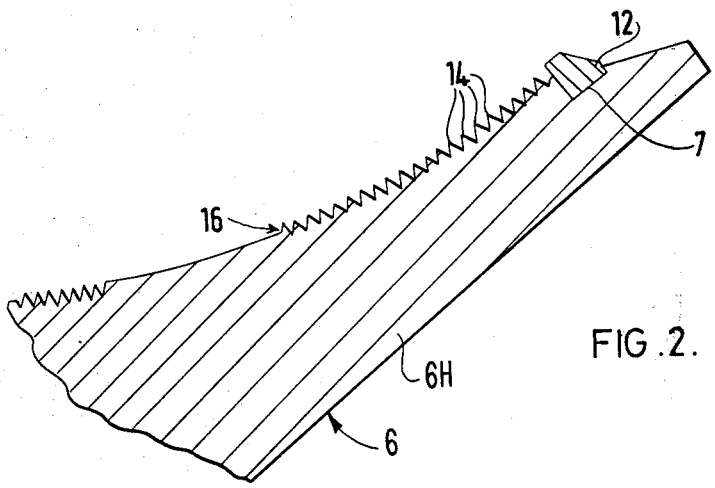
FIG. 2 is an enlargement showing the region of the fingers of the rolling plate.

As shown particularly in FIG. 2, each finger has an insert 12 which projects from a groove 7 in the operative inner face of the finger; i.e., towards the drum 8. For example, the insert 12 may project 0.75 mm from the operative face of the fingers as represented by the crests 14 of transverse serrations which are machined into the fingers. The purpose of the inserts 12 is to begin the rolling motion of the three parts of the assembly more positively and simultaneously. Rolling then continues as the assembly moves along the fingers, and proceeds further as the assembly moves along the main body of the rolling plate.

The channel between the rolling drum 8 and the opposed surface of the rolling plate 6 may, for example, for 8 mm diameter cigarettes, have a width of 8 mm minus 15 thousandths of an inch; in other words, the assemblies are compressed by 15 thousandths of an inch. On the other hand, the channel between the drum 8 and the fingers is narrower by 5 to 10 thousandths of an inch. There is a step 16 at the junction between the fingers and the body of the rolling plate, this being shown somewhat exaggerated in FIG. 1 for the sake of clarity.

As already mentioned, there are serrations which are machined into the operative faces of the fingers. In addition, there is an area 18 of the body of the rolling plate into which similar serrations are machined. Finally, there are narrower areas of serrations 20, 22, 24 and 26 machined into the body of the rolling plate, but these serrations may be omitted.

After the three parts of the assembly 4 have been joined by the wrapping paper or "cork" 10, the double-length filter-tipped cigarette thus formed is cut through the middle to form two separate filter-tipped cigarettes.

The following modification is possible. There may be fewer fingers on the rolling plate. For example, there may be three fingers comprising: a finger consisting of fingers 6A and 6B and the area between them, a similar finger consisting of fingers 6G and 6H and the area between them and a broad central finger consisting of fingers 6C, 6D, 6E and 6F and the areas between them. With this arrangement the assemblies 4 would be supported on the fluted drum only at their ends and at two positions between the fingers.

In general the invention is concerned with apparatus including a channel having a width such tht rod-like articles can be rolled through the channel by contact with relatively moving surfaces defining the channel. By providing a first region of the channel having a slightly reduced width a more positive start to the rolling of said articles through the channel may be achieved.

We claim:

1. Apparatus for causing rod-like articles such as cigarettes to roll along a predetermined path, comprising a pair of spaced opposed surfaces, a channel having a width defined by said opposed surfaces through which channel rod-like articles may be moved transversely, at least one of said surfaces being movable relative to the other surface whereby a rod-like article may be caused to roll relative to said surfaces through said channel, and means for delivering rod-like articles into said channel at an end of the channel, wherein said channel includes a first region adjacent said end and a second region downstream of said first region with respect to said end, the width of the channel in the first region being substantially constant along its length and less than the width of the channel in the second region, a transition being thereby formed in said surface between said first and second regions.

2. Apparatus as claimed in claim 1 wherein said surfaces are generally circular.

3. Apparatus as claimed in claim 1 wherein one of said surfaces is formed on a movable member and the other surface is fixed.

4. Apparatus as claimed in claim 3 wherein said one surface is the outer surface of a rotatable drum and the other surface is arcuate and partly surrounds said drum.

5. Apparatus as claimed in claim 3 wherein said first and second regions of the channel are defined by different levels of one of said surfaces, said levels being separated by a step in said one surface.

6. Apparatus as claimed in claim 5 wherein said surface having different levels is said fixed surface.

7. Apparatus as claimed in claim 3 wherein the movable member is adapted to deliver wrapper sections into said channel for rolling around rod-like articles delivered to said channel.

8. Apparatus as claimed in claim 1 wherein at least one of said surfaces is formed with serrations in the first region of the channel for contacting a rod-like article.

9. Apparatus as claimed in claim 1 wherein at least one of said surfaces is formed with serrations in the second region of the channel for contacting a rod-like article.

10. Apparatus for causing rod-like articles such as cigarettes to roll along a predetermined path, comprising a pair of spaced opposed surfaces, a channel having a width defined by said opposed surfaces through which channel rod-like articles may be moved transversely, one of said surfaces being formed on a movable member and the other surface being fixed whereby a rod-like article may be caused to roll relative to said surfaces through said channel, and means for delivering rod-like articles into said channel at an end of the channel, said channel including a first region adjacent said end and a second region downstream of said first region with respect to said end, the width of the channel in the first region being less than that in the second region, wherein the first and second regions of the channel are defined by different levels of the fixed surface, and wherein the fixed surface comprises a main part defining with said movable surface the second region of the channel and a plurality of fingers extending from the main part and defining with said movable surface the first region of the channel.

11. Apparatus as claimed in claim 10 wherein said delivering means comprises a fluted drum adapted to carry rod-like articles in its flutes and having peripheral circumferential grooves into which said fingers extend.

12. Apparatus for causing rod-like articles such as cigarettes to roll along a predetermined path, comprising a pair of spaced opposed surfaces, a channel having a width defined by said opposed surfaces through which channel rod-like articles may be moved transversely, at least one of said surfaces being movable relative to the other surface whereby a rod-like article may be caused to roll relative to said surfaces through said channel, and means for delivering rod-like articles into said channel at an end of the channel, wherein said channel includes a first region adjacent said end and a second region downstream of said first region with respect to said end, the width of the channel in the first region being less than that in the second region, the first region including a part immediately adjacent the end of the channel in which the width of the channel is less than the general width in the first region.

13. Apparatus for joining a filter portion to an axially aligned tobacco portion, comprising a first rotatable drum having an outer surface; a fixed arcuate surface spaced from said drum surface and defining therewith a channel through which said filter and tobacco portions may be rolled, said arcuate surface including a main part spaced from said drum surface by a predetermined distance and a plurality of fingers extendng from the main part and spaced from said drum surface by a distance which is slightly less than said predetermined distance; and a fluted drum arranged adjacent said first drum and said arcuate surface, said fluted drum having at least one peripheral circumferential groove into which a finger of said arcuate surface extends whereby aligned tobacco and filter portions may be delivered by said fluted drum onto said fingers and into said channel, said first drum further including means for feeding spaced wrapper sections into said channel so that as said aligned tobacco and filter portions are rolled through said channel a wrapper section is wrapped around at least the adjacent end parts of said portions to join said portions together.

14. Apparatus as claimed in claim 13 wherein said fingers have protrusions near their ends which extend towards said drum surface beyond the general level of said fingers so that the width of said channel is further reduced by said protrusions.

15. Apparatus as claimed in claim 13 wherein at least the fingers of said arcuate surface are serrated.

16. Apparatus for causing rod-like articles such as cigarettes to roll along a predetermined path, comprising a pair of spaced opposed surfaces, a channel having a width defined by said opposed surfaces through which channel rod-like articles may be moved transversely, at least one of said surfaces being movable relative to the other surface whereby a rod-like articles may be caused to roll relative to said surfaces through said channel, and means for delivering rod-like articles into said channel at an end of the channel, wherein said channel is divided into a first region adjacent said end and a second region adjacent to and downstream of said first region with respect to said end, said two adjacent regions being defined by different levels of one of said surfaces and the width of the channel in the first region being less than that in the second region, the adjacent ends of said different levels being separated along a line which is inclined to said levels.

17. Apparatus for causing rod-like articles such as cigarettes to roll along a predetermined path, comprising a pair of spaced opposed surfaces, a channel having a width defined by said opposed surfaces through which channel rod-like articles may be moved transversely, at least one of said surfaces being movable relative to the other surface whereby a rod-like article may be caused to roll relative to said surfaces through said channel, and means for delivering rod-like articles into said channel at an end of the channel, wherein said channel is divided into a first region adjacent said end a second region adjacent to and downstream of said first region with respect to said end, said two adjacent regions being defined by different levels of one of said surfaces and the width of the channel in the first region being less than that in the second region, wherein the fixed surface comprises a main part defining with said movable surface the second region of the channel, and a plurality of fingers extending from the main part and defining with said movable surface the first region of the channel.

18. Apparatus as claimed in claim 17 wherein the first region includes a part immediately adjacent the end of the channel in which the width of the channel is less than the general width in the first region.

19. Apparatus as claimed in claim 18 wherein said at least one of said surfaces is formed with serrations in the first region of the channel for contacting a rod-like articles.

20. Apparatus as claimed in claim 18 wherein at least one of said surfaces is formed with serrations in the second region of the channel for contacting a rod-like article.

* * * * *